US005097514A

United States Patent [19]

McNeill

[11] Patent Number: 5,097,514

[45] Date of Patent: Mar. 17, 1992

[54] EQUILATERAL TETRAHEDRAL SPEAKER SYSTEM

[76] Inventor: Dennis G. McNeill, 417 Temple Rd., Monaca, Pa. 15061

[21] Appl. No.: 198,419

[22] Filed: May 25, 1988

[51] Int. Cl.[5] ..... H04R 1/28; H04R 1/24

[52] U.S. Cl. ..... 381/182; 381/24; 381/111; 181/199

[58] Field of Search ..... 381/182, 188, 205, 88-90, 381/111, 116-117, 119, 120, 24; 181/153, 154; D14/30, 31, 33; 181/148, 198, 199

[56] References Cited

U.S. PATENT DOCUMENTS

| | | | |
|---|---|---|---|
| 2,544,742 | 3/1951 | Volf | 181/145 |
| 2,831,060 | 4/1958 | Kleis | 381/90 |
| 3,985,957 | 10/1976 | Torn | 181/154 |
| 4,006,308 | 2/1977 | Pönsgen | 181/154 |
| 4,031,318 | 6/1977 | Pitre | 181/148 |
| 4,122,910 | 10/1978 | Wehner | 181/148 |
| 4,142,604 | 3/1979 | Smith | 181/199 |
| 4,179,585 | 12/1979 | Herrenschmidt | 381/90 |
| 4,249,037 | 2/1981 | Dexter | 381/24 |
| 4,440,260 | 4/1984 | Jacobsen | 381/159 |
| 4,462,112 | 7/1984 | Watanabe | 381/90 |
| 4,578,809 | 3/1986 | Eberbach | 381/24 |
| 4,691,362 | 9/1987 | Eberbach | 381/24 |
| 4,787,472 | 11/1988 | Minnerath et al. | 181/145 |

FOREIGN PATENT DOCUMENTS

| | | | |
|---|---|---|---|
| 1140862 | 2/1983 | Canada | 381/24 |
| 248172 | 12/1987 | European Pat. Off. | 381/159 |
| 2825570 | 12/1979 | Fed. Rep. of Germany | 381/24 |
| 2829589 | 1/1980 | Fed. Rep. of Germany | 381/90 |
| 59-86992 | 5/1984 | Japan | 381/24 |

*Primary Examiner*—James L. Dwyer
*Attorney, Agent, or Firm*—Kirkpatrick & Lockhart

[57] ABSTRACT

A speaker system includes a plurality of substantially identical speakers carried by a speaker enclosure such that one of the speakers is centrally located with respect to the remainder of the speakers. The speakers are interconnected such that the centrally located speaker dissipates more power than the surrounding speakers whereby the speaker system mimics a vibrating surface. The speaker enclosure may take the form of an equilateral tetrahedron.

6 Claims, 7 Drawing Sheets

Fig.4. AUDIO FREQUENCY SINE WAVE SIGNAL
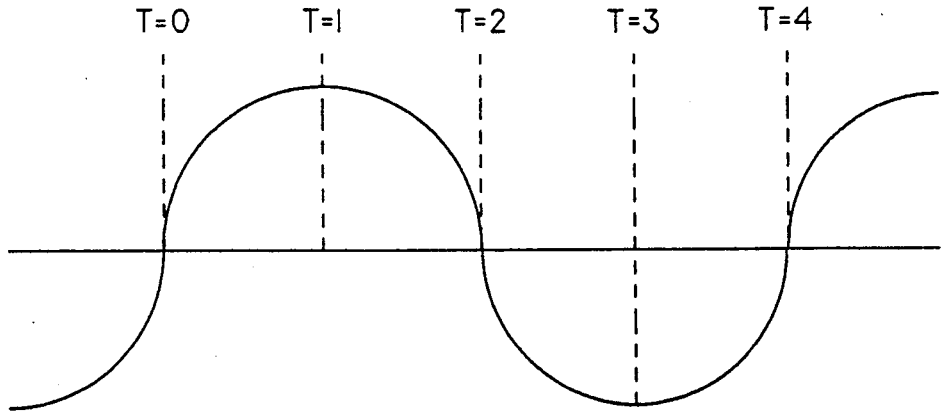
CORRESPONDING BASS STRING OPERATION
Fig.5A. 5B. 5C. 5D. 5E.
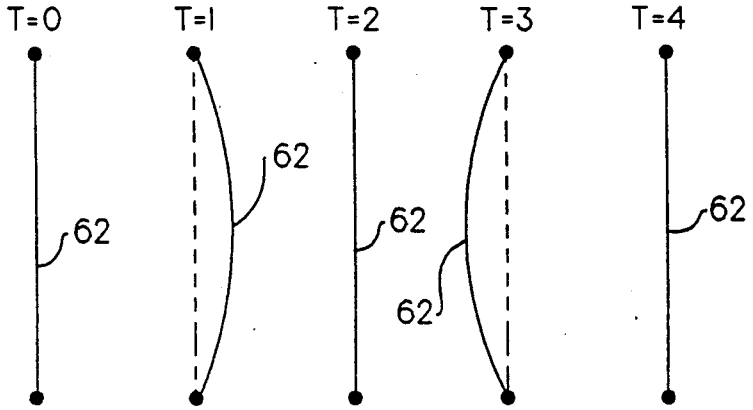
SIMALARITIES WITH SPEAKER OPERATION
Fig.6A. 6B. 6C. 6D. 6E.
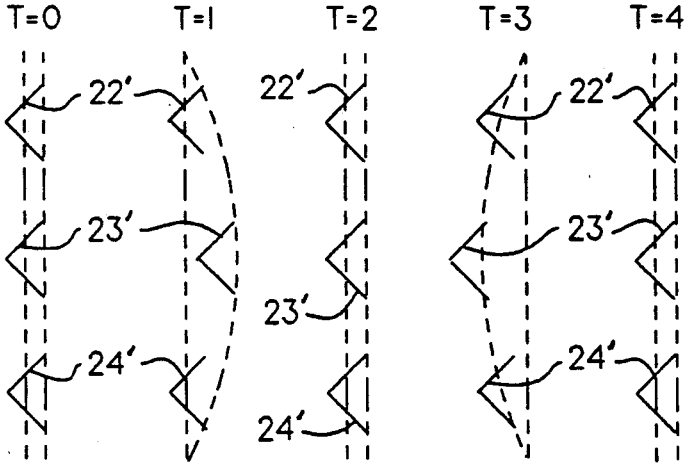

64
$T_0$
7B.
64
$T_1$
7C.
64
$T_2$
7D.
64
$T_3$

64
$T_0$
8B.
64
$T_1$
8C.
64
$T_2$
8D.
64
$T_3$

26'
25'
24'
23'
22'
$T_0$
9B.
26'
25'
24'
23'
22'
$T_1$
9C.
26'
25'
24'
23'
22'
$T_2$
9D.
26'
25'
24'
23'
22'
$T_3$

EQUILATERAL TETRAHEDRAL SPEAKER SYSTEM

BACKGROUND OF THE INVENTION

1. Field of the Invention

The present invention is directed to loudspeakers.

2. Description of the Prior Art

Numerous types of speaker systems are known in the art. For example, in U.S. Pat. No. 4,142,604 a speaker enclosure comprised of a tetrahedronal shell is disclosed. One of the walls is provided with an opening for accommodating a speaker. The wall carrying the speaker also carries a plurality of ports.

Another type of speaker system is disclosed in U.S. Pat. No. 4,179,585 which, in one embodiment, provides three sidewalls. Each of the sidewalls carries a plurality of speakers which, by virtue of a network of potentiometers, can have varying levels of power delivered thereto.

Despite the large variety of speaker systems which are currently available, the need exists for a speaker system which more accurately reproduces sound.

SUMMARY OF THE PRESENT INVENTION

The present invention is directed to a speaker system for mimicking a vibrating surface. A first plurality of substantially identical speakers is carried by an enclosure such that one of the speakers is centrally located with respect to the remainder of the speakers. The speakers are interconnected such that the centrally mounted speaker dissipates more power than each of the remaining speakers.

According to one embodiment of the present invention, the enclosure is an equilateral tetrahedron with each side adapted to carry speakers, one, of which is centrally located with respect to the remaining speakers on that side. Each of the centrally located speakers dissipates more power than each of the remaining speakers on that side.

Because of the unique shape of the speaker enclosure of the present invention, which operates in conjunction with uniquely interconnected speakers, a speaker system offering numerous advantages is provided. The speaker system of the present invention has improved sonic quality and improved dispersion characteristics and, hence, is less sensitive to room constraints. A fitting with a removable portion in the bottom of the speaker enclosure allows the speaker system to be operated in two different modes. When removed, a tuned port also radiates very low frequency bass notes and transients in all directions across the surface of the floor. The speaker enclosure of the present invention increases the sound producing diaphragm surface area in contact with the listening medium. The interconnection of the speakers of the present invention eliminates the need for a crossover network such that the present invention is free of phase problems commonly associated with such networks. The enclosure can be constructed of dense material such as a CORIAN® material to minimize enclosure coloration. CORIAN® is Dupont's registered trademark for its premium quality brand of solid surface product which is a solid, homogeneous, filled material containing methyl methacrylate. The unique shape of the enclosure provides an enclosure that is highly stable and has a low center of gravity. The speaker enclosure is simple to construct and easy to repair. By virtue of providing casters or rollers on the bottom of the speaker enclosure, the enclosure can be easily moved. In operation, the present invention more closely resembles a vibrating surface at low audio frequencies. These and other advantages and benefits of the present invention will become apparent from the description of a preferred embodiment hereinbelow.

BRIEF DESCRIPTION OF THE DRAWINGS

In order that the present invention may be clearly understood and readily practiced, a preferred embodiment will now be described, by way of example only, with reference to the accompanying figures wherein:

FIGS. 4, 5A–5E, and 6A–6E illustrate how the speaker system of the present invention mimics the movement of a bass string;

FIGS. 7A–7D, 8A–8D and 9A–9D illustrate how the speaker system of the present invention mimics the movement of a bass drum head;

DESCRIPTION OF THE PREFERRED EMBODIMENT

Figure 1:
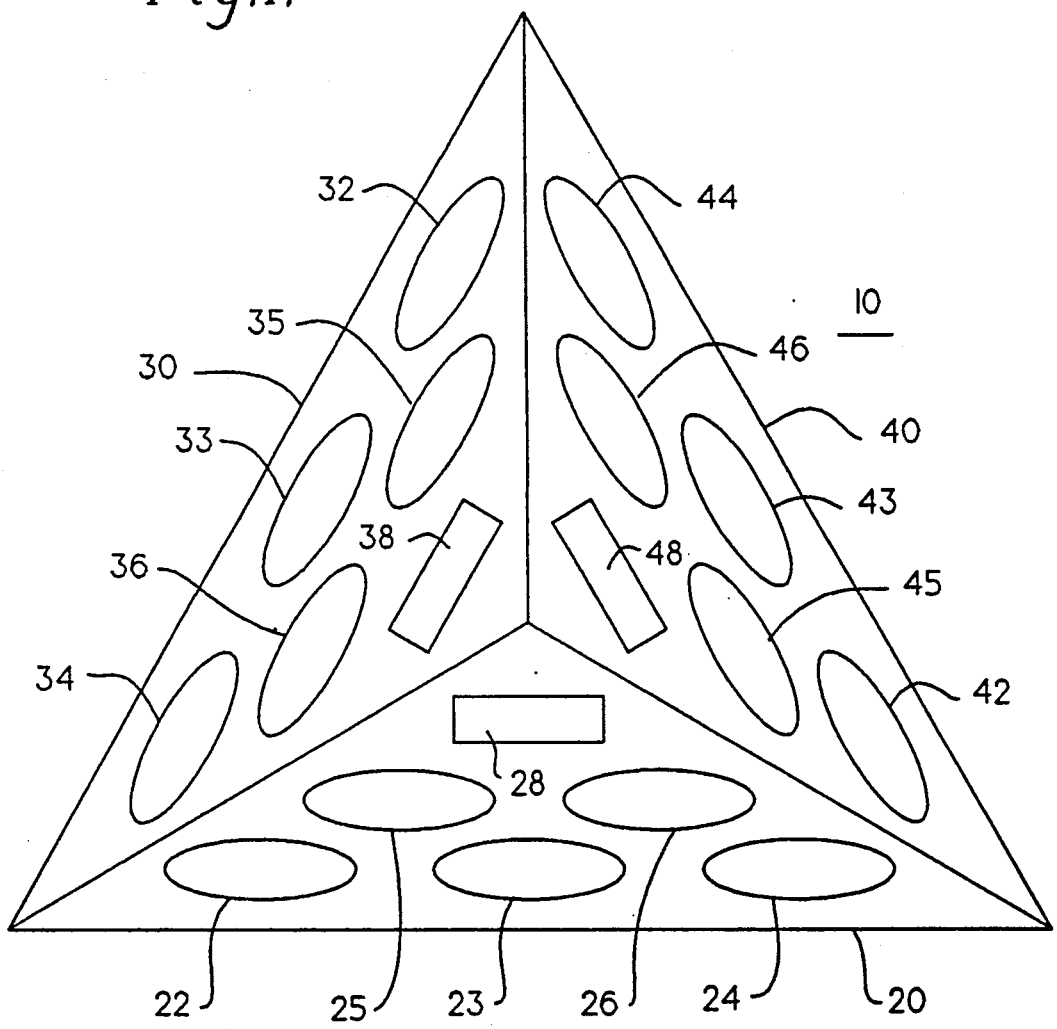
FIG. 1 is a top view of a speaker enclosure constructed according to the teachings of the present invention.

A speaker enclosure 10 constructed according to the teachings of the present invention is illustrated in FIG. 1. The speaker enclosure 10 may be an equilateral tetrahedron which is viewed from the top in FIG. 1. The tetrahedron is comprised of a first side 20, a second side 30, and a third side 40. Departing from the conventional cubical or rectangular box-shaped speaker enclosures is one of the most apparent features of the present invention. The speaker enclosure 10 of the present invention is inherently less resonant due to the increased cross sectional area of the corners and the absence of parallel sides. This shape also provides a very low center of gravity such that the speaker enclosure 10 cannot easily be toppled.

Each of the sides 20, 30, and 40 is identical in construction. The side 20 carries a plurality of apertures 22, 23, 24, 25, and 26 which are adapted to receive speakers 22', 23', 24', 25', and 26' shown in FIG. 2. The speakers 22' through 26' are identical in construction and operation and may be of any known type of speaker such as VersaTronics #D0130-PP-8. Each of the speakers 22' through 26'0 has a driver 122, 123, 124, 125, and 126, respectively, as is known.

Figure 2:
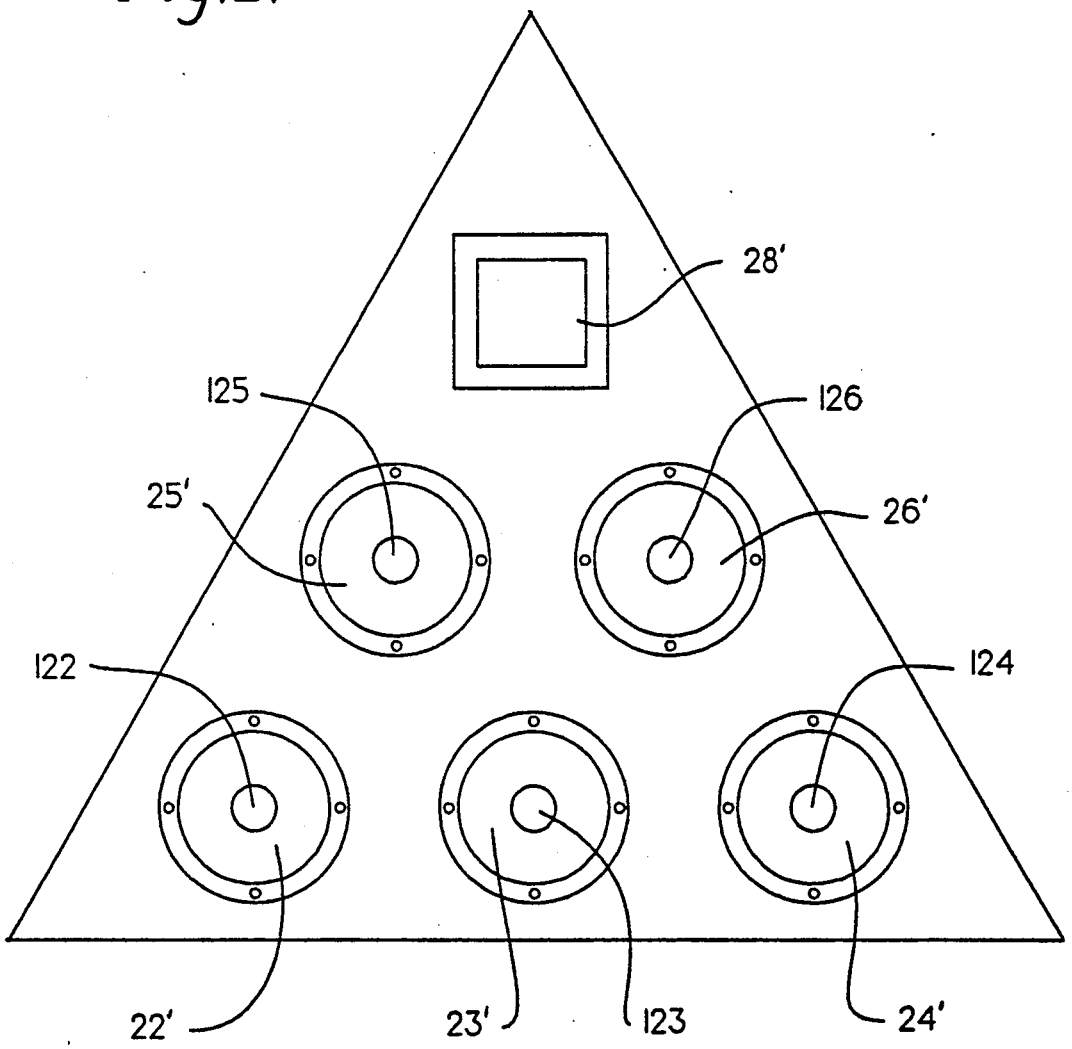
FIG. 2 illustrates one side of the speaker enclosure shown in FIG. 1.

The side 20 also carries a tweeter aperture 28 adapted for receiving a relatively high impedance tweeter 28' shown in FIG. 2. The tweeter may be a known piezoelectric type of tweeter such as Motorola #KSN-1071A which suppresses any harshness, remains flat up through 40,000 hertz, and reproduces the audio high frequency spectrum with great clarity.

The remaining sides 30 and 40 are constructed in the same manner as side 20 such that each side is provided with a plurality of openings adapted to receive a tweeter and a plurality of speakers, with one of the speakers on each side being centrally mounted with respect to the remainder of the speakers on that side.

Figure 3:
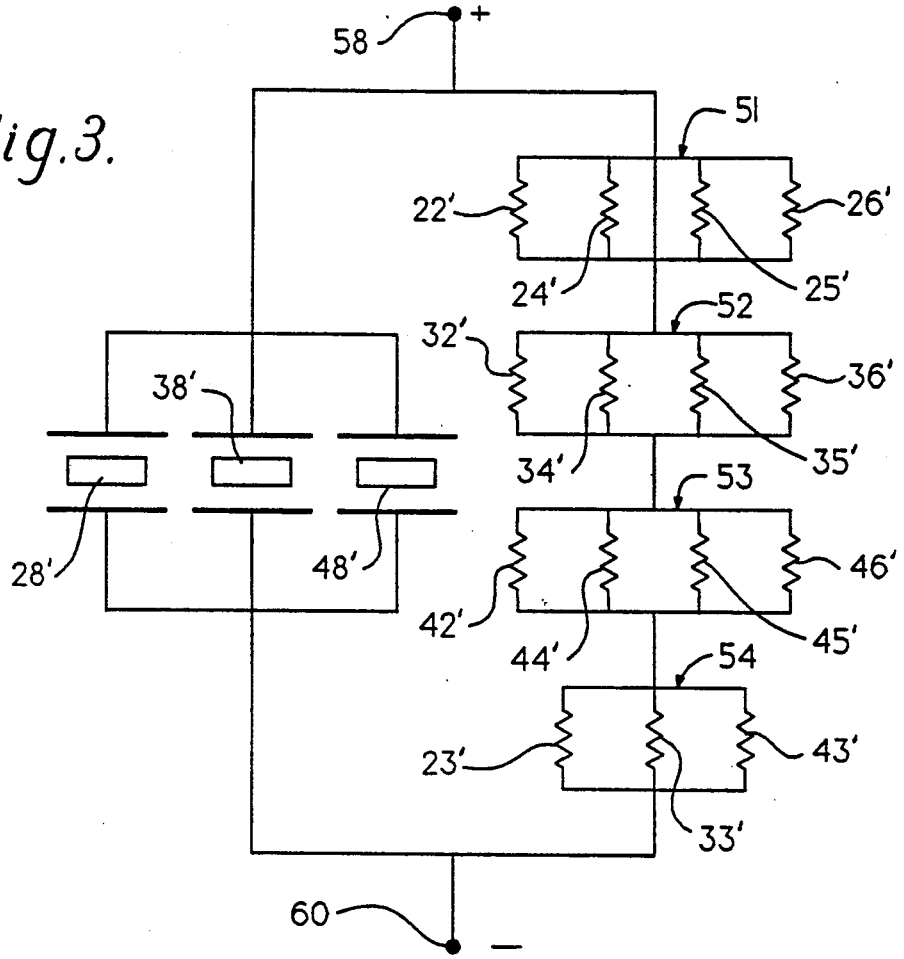
FIG. 3 illustrates the electrical connection of the speakers.

The electrical connection of the speakers carried by the enclosure 10 is illustrated in FIG. 3. Four of the speakers 22', 24', 25', and 26' carried by the first side 20 are electrically connected in parallel to form a first bank of parallel connected speakers 51. In a similar fashion, four speakers 32', 34', 35', and 36' carried by the second side 30 are electrically connected in parallel to form a second bank of parallel connected speakers 52. Four of the speakers 42', 44', 45', and 46' carried by the third side 40 are electrically connected in parallel to form a third bank of parallel connected speakers 53. The remaining speakers, 23' of the first side 20, 33' of the second side 30, and 43' of the third side 40, are connected in parallel to form a fourth bank of parallel connected speakers 54. The banks 51, 52, 53, and 54 of parallel connected speakers are connected in series across input terminals 58 and 60. Each of the tweeters 28', 38', and 48' is also connected across the input terminals 58 and 60.

By connecting the speakers in this manner, the current delivered to each of the speaker banks 51, 52, 53, and 54 is the same. However, because there are only three speakers, 23', 33', and 43', in the fourth speaker bank 54, each of those speakers is required to dissipate more power than the speakers in the other speaker banks. Thus, of the speakers carried by the first side 20, the speaker 23' must dissipate more power than the surrounding speakers 22', 24', 25', and 26'. That allows the speakers carried by the enclosure of the present invention to more closely mimic a surface vibrating at a low audio frequency as more fully described hereinbelow.

FIG. 4 illustrates an audio frequency sine wave corresponding to the vibrations of a bass string 62 illustrated in FIGS. 5A through 5E. The diaphragms of speakers 22', 23', and 24' are illustrated in FIGS. 6A through 6E. At time T0 the bass string 62 is at a rest position such that the value of the sine wave is zero. Correspondingly, the diaphragms of speakers 22', 23', and 24' are also at a rest position as shown in FIG. 6A. At time T1 the string 62 is displaced a maximum distance from its rest position as shown in FIG. 5B. As can be seen, the center of the bass string 62 is displaced a greater distance than are the ends of the bass string. That movement is mimicked by the diaphragms of speakers 22', 23', and 24' as shown in FIG. 6B. Because of the manner in which the speakers are connected, the speaker 23' must dissipate more power than the speakers 22' and 24'. That results in the diaphragms of speaker 23' being displaced a greater distance than the diaphragms of speakers 22' and 24'. In this manner, the displacement of the bass string 62 is mimicked.

At time T2, the bass string, as shown in FIG. 5C, is at a rest position such that the sine wave assumes a value of zero and the diaphragms of speakers are at a rest position as shown in FIG. 6C. In FIG. 5D, the bass string assumes a position opposite of the position shown in FIG. 5B. Accordingly, the diaphragnms of speakers 22', 23', and 24' assume a position opposite of that shown in FIG. 6B. At time T4 the string 62 is at rest as are the speakers as shown in FIG. 6E.

Figures 7A, 8A, 9A:
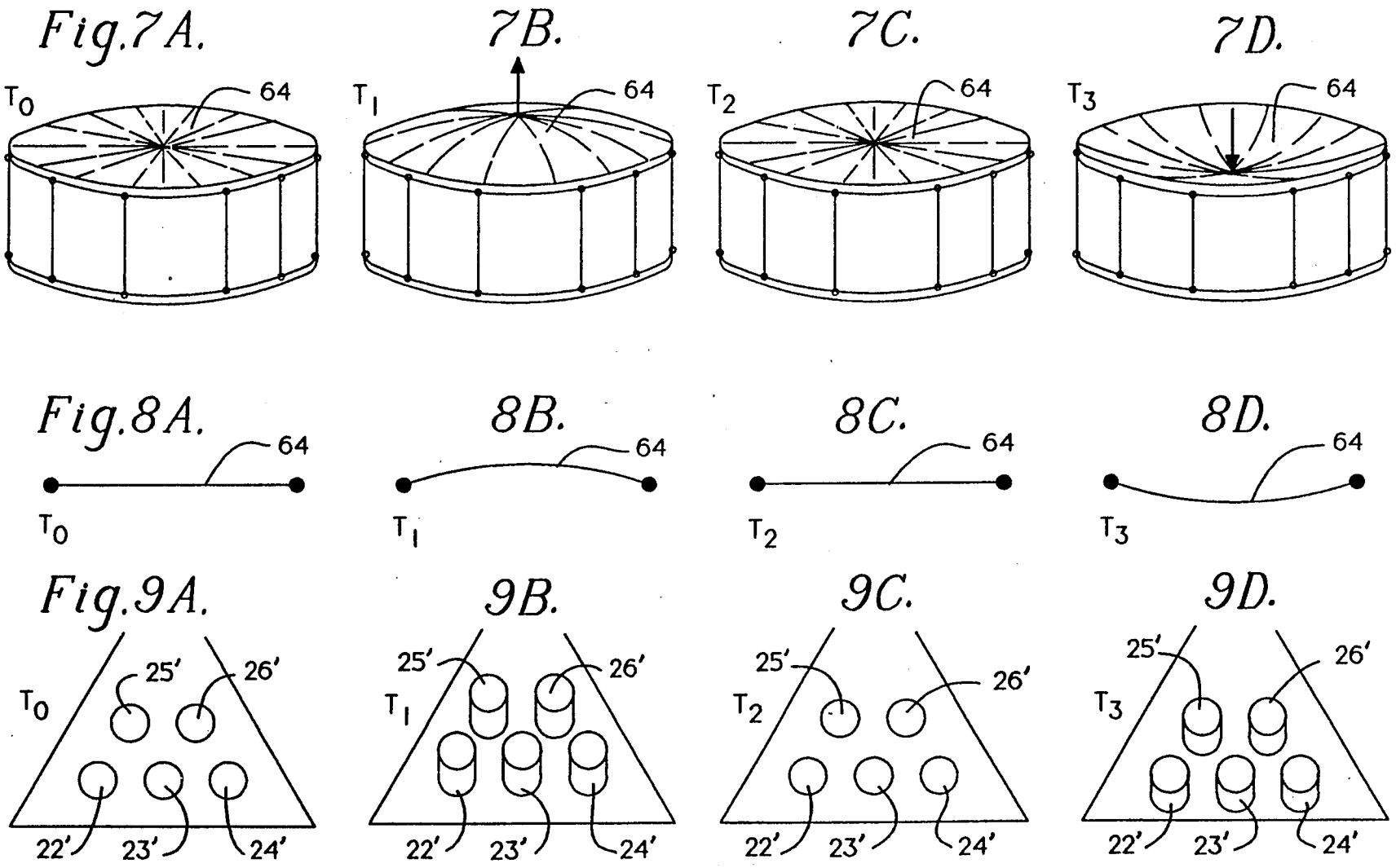

The same principle can be used to mimic the three-dimensional movement of a bass drum head 64 as illustrated in FIGS. 7A through 7D (shown in cross-section in FIGS. 8A through 8D) by means of the speakers shown in FIGS. 9A through 9D. As seen in FIGS. 7B, 8B and 9B, the movement of the diaphragms of speaker 23', shown greatly exaggerated, is greater than the movement of the diaphragms of speakers 22', 24', 25' and 26', also shown greatly exaggerated, thereby mimicking the movement of the bass drum head 64. A similar condition exists at time T3 as shown in FIGS. 7D, 8D and 9D.

In addition to enabling the present invention to more closely resemble a surface vibrating at a low audio frequency, a speaker system utilizing the enclosure of the present invention has three times the normal moving surface area. The speaker system operates in a manner that produces low frequency transients and impact normally absent in single woofer designs. This also increases power handling capabilities while decreasing the possibility of permanent damage.

Another significant advantage of the present invention is the elimination of crossover networks. The elimination of such networks eliminates problems, such as driver phase and power losses, associated with such networks. Passive crossover components such as capacitors and coil inductors absorb power and change phase. The design of the present invention has low and high frequency drivers electrically connected in phase and operated in phase throughout the audio frequency spectrum. As a result, all drivers within the enclosure are operating in phase all of the time and critical phase relationships between drivers are retained.

Figure 10:
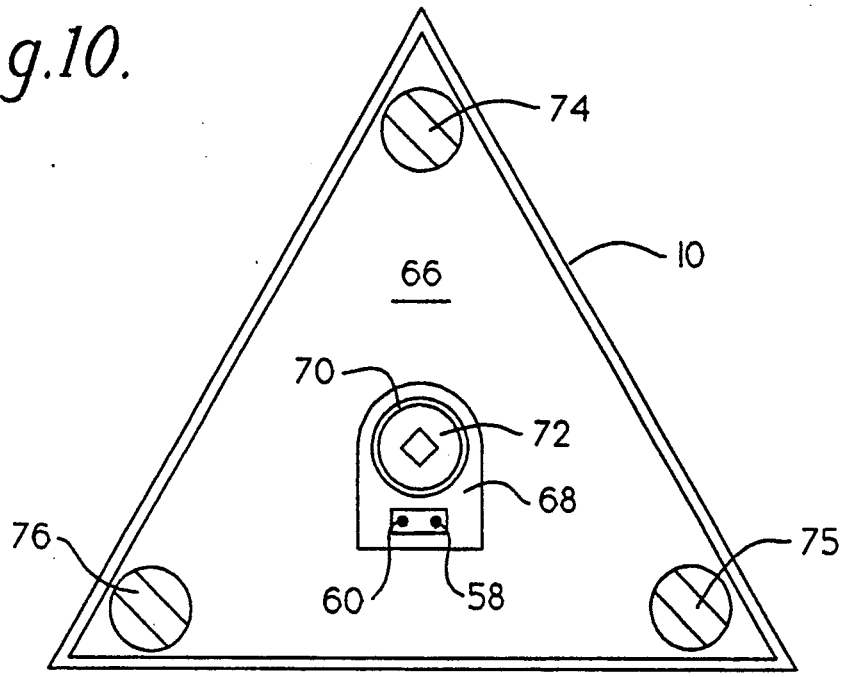
FIG. 10 illustrates the bottom of the speaker enclosure shown in FIG. 1.

A bottom 66 of the speaker enclosure 10 is illustrated in FIG. 10. The bottom may be constructed of a triangularly-shaped piece of three-quarter inch hardwood plywood. A member 68 is recessed mounted in the bottom 66. The member 68 carries the input terminals 58 and 60. The member 68 also carries a large pipe fitting 70 having a removable portion or plug 72. The removable portion 72 of the fitting 70 allows the speaker enclosure 10 of the present invention to be operated in two modes as illustrated in FIGS. 11 and 12.

Figure 11:
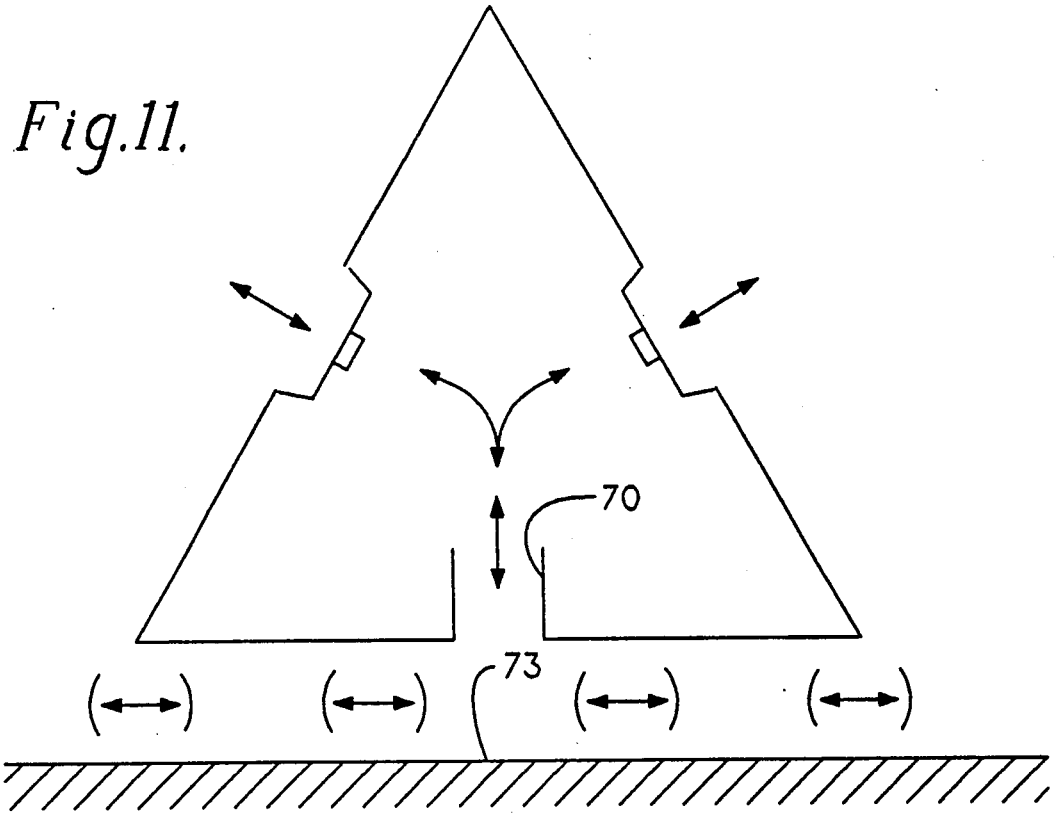
FIGS. 11 and 12 illustrate two modes of operation for the present invention.
Figure 12:
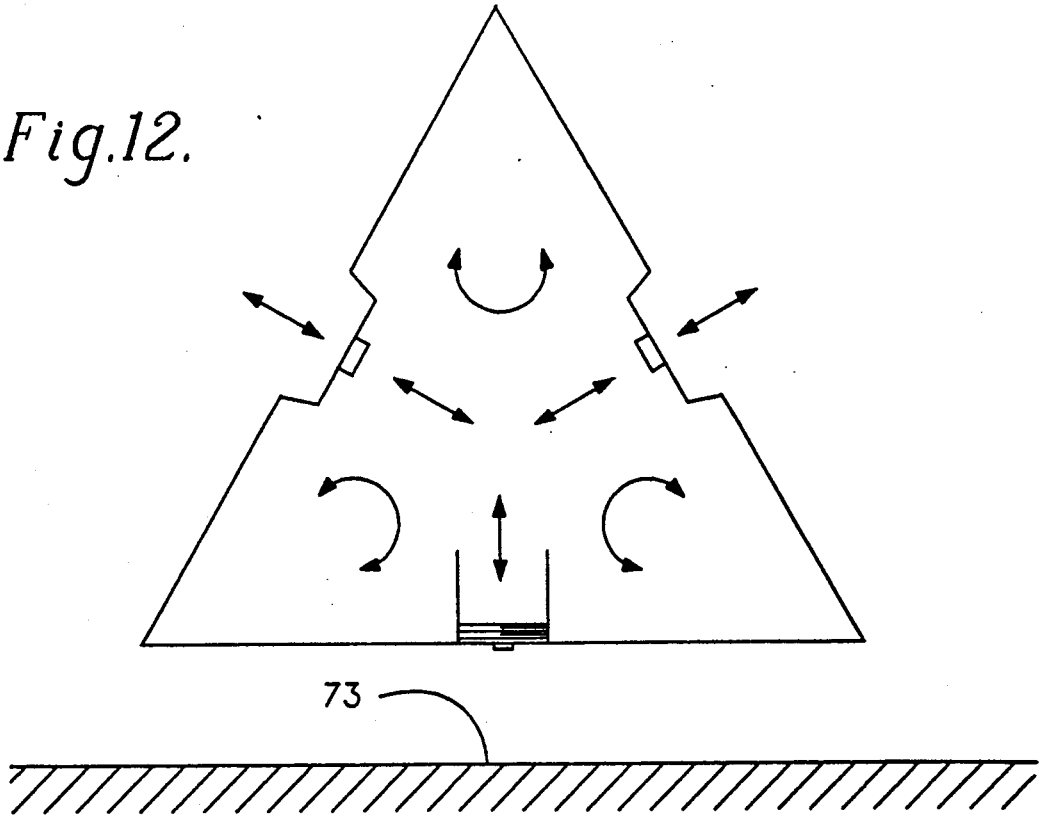

In FIG. 11, with the removable portion 72 removed, the opening thus created operates as tuned port. The amplitude of the signal produced by the port is multiplied due to the large number of drivers forcing air into the small opening and toward the floor 73. In FIG. 12, with the removable portion 72 in place, air is captured within the enclosure 10. This type of air suspension operation uses the captured air to support speaker diaphragm movement.

Returning to FIG. 10, the bottom 66 may also carry casters 74, 75, and 76 which enable the speaker enclosure 10 to be easily moved.

With drivers mounted on all three sides of the speaker enclosure 10, which sides naturally tilt upward, the dispersion characteristics of the present invention are excellent. This allows the system to be placed anywhere in a room without location constraints. The present enclosure can be used with any quality receiver or amplifier. Because of its smooth frequency response, a compensation circuit or equalizer is not required. With the removable portion 72 removed, the low frequencies can interact with the room's environment. With the removable portion 72 in place, the system can be operated at very high power levels and distortion caused by low frequency noise can be reduced. The casters 74, 75, and 76 together with the input terminals 58 and 60 make for excellent mobility and easy operation.

Figure 14:
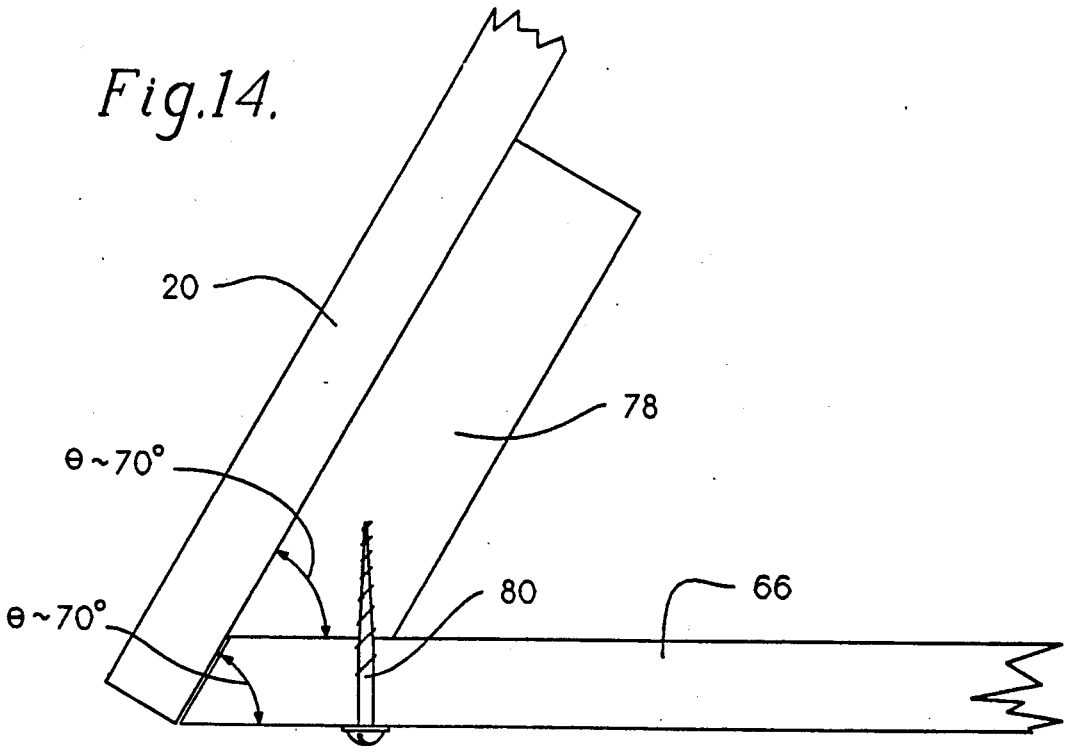
FIGS. 13 and 14 illustrate construction details.
Figure 13:
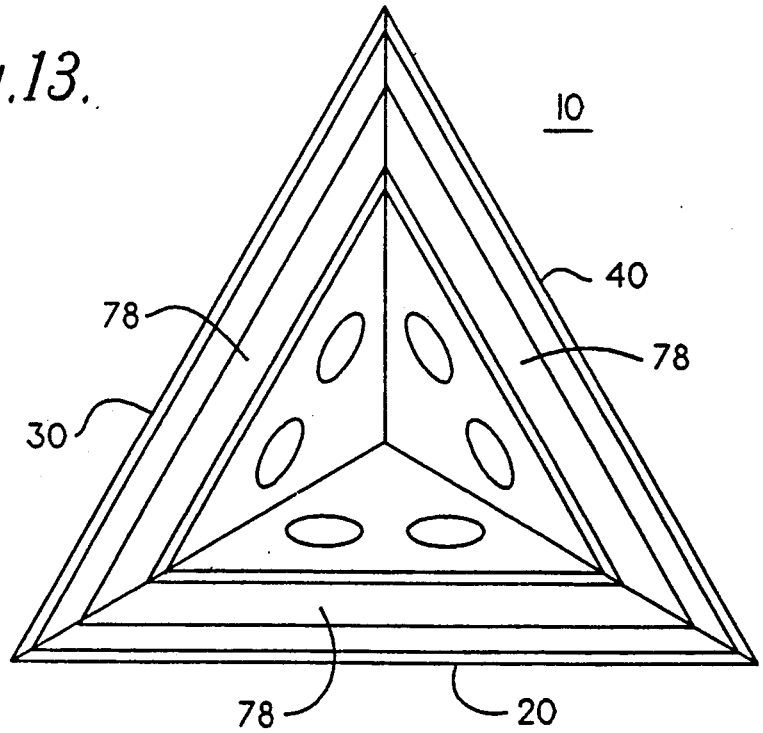

Although any known type of construction technique and construction materials may be used to construct the enclosure of present invention, certain techniques and materials are discussed in conjunction with FIGS. 13 and 14. FIG. 13 is a view looking up inside the speaker enclosure 10 with the bottom 66 removed. FIG. 14 illustrates the connection of the bottom 66 to one side 20. The sides 20, 30 and 40 may be constructed of a dense material such as CORIAN® material. Two by fours 78, cut to an appropriate angle as shown in FIG. 13, may be glued to the sides with high strength neoprene panel adhesive. Thereafter, the base 66 may be removably attached to the two by fours 78 through the use of fastening means such as wood screws 80. This type of construction leads to a substantially airtight enclosure. The CORIAN® material is a dense mineral impregnated material which is denser than wood and thus resonates less. The CORIAN® material is a very high quality and advanced synthetic material resembling marble and granite in appearance and density thereby decreasing resonance and coloring of the enclosure.

Aesthetically, the shape, quality, and materials comprising the present invention combine to form an excellent speaker system with a monolithic appearance. The construction material, CORIAN®, is available in many textures and colors from marble white to granite dark grey which evoke the feeling of richness and elegance that enhances any interior design.

While the present invention has been described in connection with an exemplary embodiment thereof, it will be understood that many modifications and variations will be readily apparent to those of ordinary skill in the art. This disclosure and the following claims are intended to cover all such modifications and variations.

What I claim is:

1. A speaker system for approximating the movement of a vibrating surface, comprising:

a first plurality of at least three substantially identical speakers, each speaker having a diaphragm;

means for carrying said speakers such that one of said speakers is centrally located with respect to the remaining of said speakers; and means for electrically interconnecting said first plurality of speakers such that each speaker is responsive to substantially the same portion of the audio frequency spectrum and said diaphragm of said centrally located speaker moves a greater distance than the diaphragms of each of said remaining speakers such that said plurality of speakers approximates the movement of the vibrating surface without any user adjustments.

2. The speaker system of claim 1 wherein said means for carrying said speakers includes an equilateral tetrahedronal enclosure having first, second, and third sides.

3. The speaker system of claim 2 wherein said first plurality of speakers is carried by said first side.

4. The speaker system of claim 3 additionally comprising a second plurality of speakers carried by said second side and a third plurality of speakers carried by said third side such that each side has a centrally located speaker with respect to the remaining speakers of that side's plurality of speakers.

5. The speaker system of claim 4 wherein said means for interconnecting interconnects in parallel said remaining speakers of said first plurality of speakers to form a first speaker bank, interconnects in parallel said remaining speakers of said second plurality of speakers to form a second speaker bank, interconnects in parallel said remaining speakers of said third plurality of speakers to form a third speaker bank, interconnects in parallel said centrally located speakers to form a fourth speaker bank, and interconnects all of said speaker banks in series.

6. The speaker system of claim 5 wherein said first, second, and third pluralities of speakers include low frequency speakers.

* * * * *

UNITED STATES PATENT AND TRADEMARK OFFICE

CERTIFICATE OF CORRECTION

PATENT NO. : 5,097,514
DATED : March 17, 1992
INVENTOR(S) : Dennis G. McNeill

It is certified that error appears in the above-identified patent and that said Letters Patent is hereby corrected as shown below:

Col. 1, line 36, delete "one," and substitute --one-- therefore.

Col. 2, line 55, delete "VersaTronics" and substitute --Versa-Tronics-- therefore.

Col. 2, line 56, delete "26'0" and substitute --26'-- therefore.

Col. 3, line 51, delete "diaphragms" and substitute --diaphragm-- therefore.

Col. 3, line 60, delete "diaphragnms" and substitute --diaphragms-- therefore.

Col. 4, line 1, delete "diaphragms" and substitute --diaphragm-- therefore.

Signed and Sealed this

Eighth Day of June, 1993

*Attest:*

Michael K. Kirk

MICHAEL K. KIRK

*Attesting Officer*

*Acting Commissioner of Patents and Trademarks*